US006336023B1

(12) United States Patent
Toyama et al.

(10) Patent No.: US 6,336,023 B1
(45) Date of Patent: Jan. 1, 2002

(54) ELECTROPHOTOGRAPHIC IMAGE-FORMING APPARATUS HAVING A STATIC ELIMINATOR

(75) Inventors: Toshimasa Toyama, Kawasaki; Seiji Suketomo, Hyogo, both of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/653,006

(22) Filed: Aug. 31, 2000

(30) Foreign Application Priority Data

Dec. 22, 1999 (JP) ..... 11-364607

(51) Int. Cl.[7] ..... G03G 15/045; G03G 15/08
(52) U.S. Cl. ..... 399/296; 399/66
(58) Field of Search ..... 399/296, 66

(56) References Cited

U.S. PATENT DOCUMENTS 4,853,736 A * 8/1989 Goto et al. ..... 399/296
5,333,037 A * 7/1994 Inoue et al. ..... 399/66

FOREIGN PATENT DOCUMENTS

| | | |
|---|---|---|
| JP | 56-6277 | * 1/1981 |
| JP | 2-254486 | 10/1990 |
| JP | 7-199588 | 8/1995 |
| JP | 8-202158 | 8/1996 |
| JP | 8-234535 | 9/1996 |
| JP | 9-304991 | 11/1997 |

* cited by examiner

*Primary Examiner*—Quana M. Grainger
(74) *Attorney, Agent, or Firm*—Armstrong, Westerman, Hattori, McLeland, and Naughton, LLP

(57) ABSTRACT

An electrophotographic printer includes a photosensitive drum, a developing unit, an image transfer unit, and pre-transfer discharges arranged between the developing unit and the image transfer unit. The pre-transfer discharging means is arranged to progressively reduce the absolute value of the electric potential of a given point in the surface of the photosensitive drum. The reduction of the electric potential is performed in a non-abrupt manner through two or more steps as the given point is moved from the developing unit to the image transfer unit.

9 Claims, 9 Drawing Sheets

FIG.3

| | POTENTIAL(V) | ΔPOTENTIAL(V) | PRINT DUST | EVALUATION |
|---|---|---|---|---|
| FROM −700V | −700 | 0 | ○ | 5 |
| | −600 | 100 | ○ | 5 |
| | −550 | 150 | ○ | 5 |
| | −500 | 200 | △ | 4 |
| | −450 | 250 | △ | 3 |
| | −400 | 300 | × | 1 |
| | −200 | 500 | × | 1 |
| | 0 | 700 | × | 1 |

FIG.4

| | POTENTIAL(V) | ΔPOTENTIAL(V) | PRINT DUST | EVALUATION |
|---|---|---|---|---|
| FROM −550V | −550 | 0 | ○ | 5 |
| | −500 | 50 | ○ | 5 |
| | −450 | 100 | ○ | 5 |
| | −400 | 150 | ○ | 5 |
| | −350 | 200 | ○ | 5 |
| | −300 | 250 | △ | 4 |
| | −250 | 300 | × | 2 |
| | −200 | 350 | × | 1 |
| | 0 | 550 | × | 1 |

ELECTROPHOTOGRAPHIC IMAGE-FORMING APPARATUS HAVING A STATIC ELIMINATOR

BACKGROUND OF THE INVENTION

1. Field of the Invention

The present invention relates to an electrophotographic image-forming apparatus. In particular, it relates to an electrophotographic image-forming apparatus of the type which is provided with a static eliminator disposed between an image-developing unit and an image-transferring unit for reducing the absolute value of the electric potential of the surface of a photosensitive component.

2. Description of the Related Art

Electrophotographic image-forming apparatuses come in several varieties, including laser printers, LED printers, photocopiers, etc. In such an image-forming apparatus, a light source, which consists of, e.g., an LED array, is provided for irradiating the surface of the photosensitive drum with light at a location between the image-developing unit and the image-transferring unit. Shining on the drum surface, the light serves to reduce the absolute value of the potential of the "background portion" (i.e., the portion which is not covered by toner) on the drum. In this manner, proper image-transferring performance and toner-cleaning performance can be expected.

A conventional image-forming apparatus of the above type has been found disadvantageous in the following point. The light source of a conventional apparatus is arranged to irradiate only a single region in the drum surface. In this manner, however, the absolute value of the potential on the drum surface is reduced sharply, for example, from −700V to 0V at one time. As a result, toner particles, which have once settled on the intended portion ("image portion") on the drum surface, may be scattered around due to the sudden potential drop and then stick to the background portion on the drum. This may degrade the print quality to an unacceptable extent.

More specifically, it is now supposed that the background portion and image portion on the surface of the photosensitive drum have a potential of −700V and 0V, respectively, as shown in FIG. 9. The difference in potential generates an electric field E between the background and the image portions. In general, an electric field between two points becomes greater as the potential difference between these points is greater and the distance between them is smaller. Due to the electric field E, a force F is exerted on the negatively charged toner particles, urging them from the background portion to the image portion. The electric field E is rendered greatest at points adjacent to the boundaries between the background portion and the image portion, since the distance between these points and the background portion is small. As a result, the toner particles located adjacent to the boundaries are most firmly fixed in position by the force F, so that they will not be unduly moved from the image portion to the background portion. This phenomenon is generally known as "Edge Effect."

The illustrated potential difference (700V in FIG. 9) between the image portion and the background portion may be reduced to about 0V by irradiating the photosensitive drum with light. As a result, the electric field E (and hence the force F as well) will vanish.

Before the force F has gone, the toner particles are fixed in position on the drum surface, being pressed onto the drum surface by the force F which is balanced out by the reactional force Fr from the drum surface. However, when the force F suddenly disappears, the toner particles tend to be moved away from the drum surface by the reactional force Fr to be scattered around. In particular, the above-mentioned edge effect causes a greater amount of toner particles to collect at the boundaries between the image portion and the background portion. Thus, the scattering of toner particles by the reaction force Fr will occur to a greater extent at the boundaries.

Among the scattered toner particles, some may be attached to the background portion on the drum surface, as shown in FIG. 10. These unfavorable printing blots (hereinafter called "print dust") may unacceptably degrade the print quality.

SUMMARY OF THE INVENTION

It is, therefore, an object of the present invention to provide an image-forming apparatus which can enjoy excellent image-transfer and cleaning performances without suffering from the print dust as described above.

According to the present invention, there is provided an electrophotographic image-forming apparatus comprising: a photosensitive member having a surface upon which an electrostatic image is produced; a developing unit arranged adjacent to the photosensitive member; an image transfer unit arranged adjacent to the photosensitive member; and pre-transfer discharging means arranged adjacent to the photosensitive member between the developing unit and the image transfer unit. The pre-transfer discharging means is arranged to incrementally reduce an absolute value of an electric potential of a given point in said surface of the photosensitive member through more than one step as said given point is moved from the developing unit to the image transfer unit.

With such an arrangement, the absolute value of the electric potential of the surface of the photosensitive member is not sharply reduced between the developing unit and the image transfer unit. Thus, the toner-developed images produced on the surface of the photosensitive member are stably adhered to the surface, thereby causing no print dust.

In addition, the absolute value of the electric potential of the photosensitive member can be sufficiently reduced in the above manner while a given point in the surface of the photosensitive member is being moved from the developing unit and to the image transfer unit. Thus, the image transfer from the photosensitive member onto the recording medium and the cleaning of the surface of the photosensitive member can still be performed properly, as in the conventional apparatus.

According to a preferred embodiment, the pre-transfer discharging means is provided with a plurality of light sources for irradiating different portions of said surface of the photosensitive member.

Preferably, the photosensitive member may comprise a drum rotatable about an axis. In this instance, the light sources may be spaced from each other circumferentially of the drum.

According to another preferred embodiment of the present invention, the pre-transfer discharging means is provided with a single light source and a slit plate which is located between the photosensitive member and the light source.

Preferably, the slit plate may be formed with a plurality of slits for splitting light from the light source to irradiate different portions of said surface of the photosensitive member.

According to still another preferred embodiment of the present invention, the pre-transfer discharging means is provided with a single light source and a light controller for repeatedly turning on the light source at predetermined time intervals as said given point is moved from the developing unit to the image transfer unit.

Preferably, the image-forming apparatus of the present invention may further comprise a remnant charge discharger for irradiating the photosensitive member with light after a developed image is transferred onto recording medium. The pre-transfer discharging means is arranged to emit light whose specific light energy is no greater than one fifth (1/5) of a specific light energy of the light from the remnant charge discharger.

Preferably, the pre-transfer discharging means may be arranged to emit light of a predetermined wavelength which renders a spectral sensitivity of the photosensitive member no greater than half the maximum value of the spectral sensitivity.

Preferably, the pre-transfer discharging means incrementally may reduce the absolute value of the electric potential of said given point by no greater than 150V at one time.

Other features and advantages of the present invention will become apparent from the detailed description given below with reference to the accompanying drawings.

BRIEF DESCRIPTION OF THE DRAWINGS

FIGS. 3 and 4 are tables showing the relationship between the potential drop on the drum surface and the occurrence of the print dust;

DETAILED DESCRIPTION OF THE PREFERRED EMBODIMENTS

The preferred embodiments of the present invention will be described below with reference to the accompanying drawings.

Figure 1:
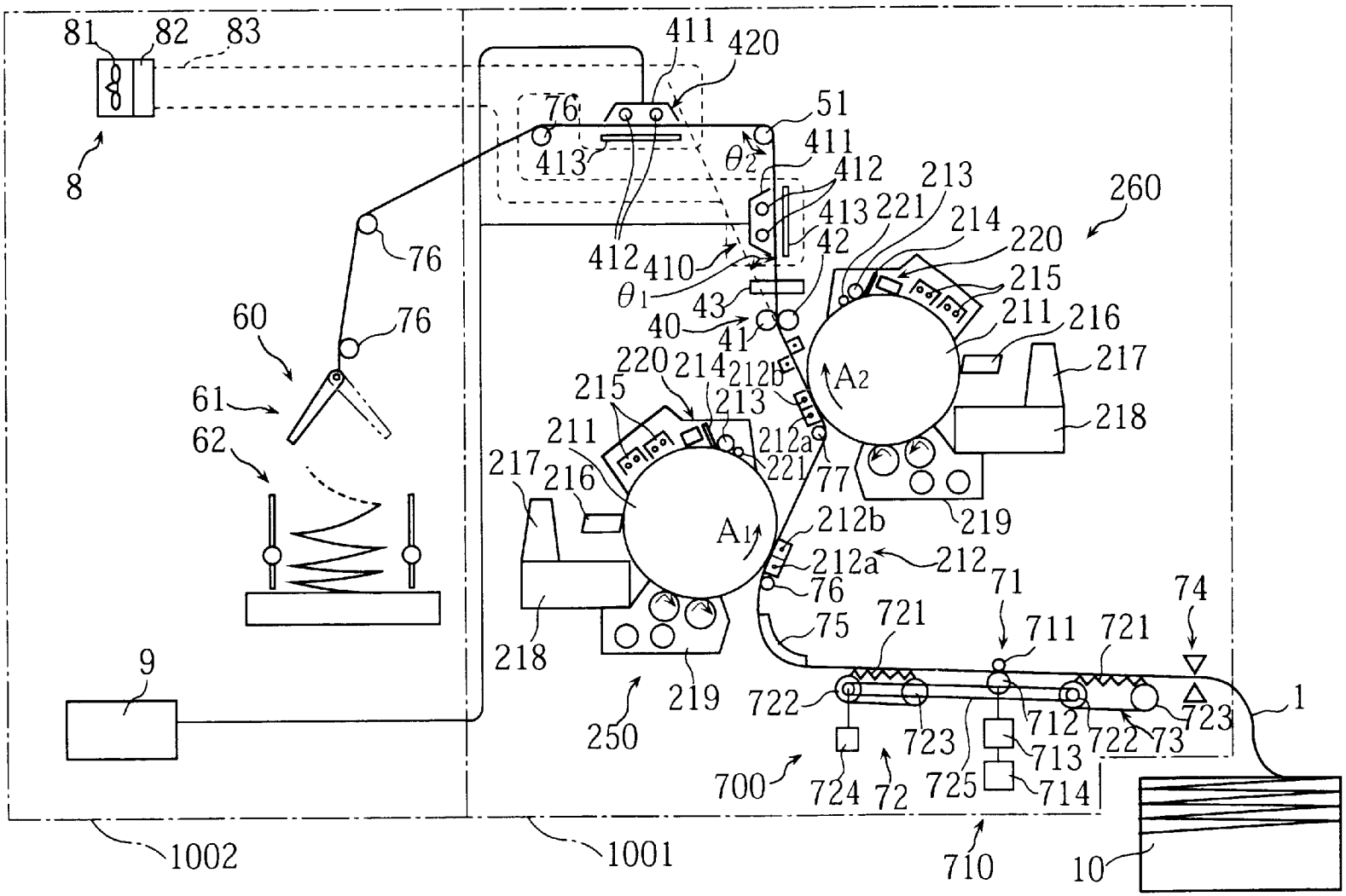
FIG. 1 is a schematic side view showing the layout of an image-forming apparatus embodying the present invention.

Reference is first made to FIG. 1 which shows the principal components of an electrophotographic image-forming apparatus according to a first embodiment of the present invention. As illustrated, the image-forming apparatus is provided with a paper hopper 10, a transfer system 700, a first image-forming unit 250, a second image-forming unit 260, a first fixing unit (flash type) 410, a second fixing unit (flash type) 420, a paper stacker 60, a blower 8, and a power source 9 for the fixing units.

The paper hopper 10 holds new recording paper 1 in an alternately folded manner, as shown in FIG. 1. In operation, the recording paper 1 is paid out successively from the hopper 10 for performing printing thereon. An operator or user of the apparatus can readily set the recording paper 1 into the hopper 10 by removing the hopper 10 from the main body of the image-forming apparatus.

The recording paper 1 is a continuous form of paper formed with perforations. When severed along the perforations, the recording paper 1 is divided into individual sheets of paper of the same size. The recording paper 1 is also formed with regularly spaced indexing holes arranged along each longitudinal edge.

The first image-forming unit 250 is provided for forming images on the reverse side of the recording paper 1 under the control of a controller (not shown). The first image-forming unit 250 is an electrophotographic device designed to transfer developed toner images onto the recording paper 1. For this purpose, the unit 250 includes a photosensitive drum 211, an LED light irradiator 216, drum chargers 215, a cleaning unit 220, and a developing unit 219 associated with a toner hopper.

In a printing operation, the photosensitive drum 211 is caused to rotate in a direction Al (counterclockwise in FIG. 1) while being held in contact with the recording paper 1. With such an arrangement, a toner image formed on the drum 211 is transferred onto the recording paper 1 as the drum 211 is rotating in contact with the paper 1.

The cleaning unit 220 is arranged above the photosensitive drum 211 for collecting the leftover toner (or remnant toner) on the drum surface. The cleaning unit 220 is provided with a cleaning blade 214, a cleaning brush 213, and a toner-discharging screw 221.

The cleaning blade 214 comes into contact with the entire width of the surface of the drum 211 at predetermined angles. With such an arrangement, the leftover toner on the drum surface is effectively removed as the drum 211 rotates in the direction A1.

The cleaning brush 213 is also held in contact with the photosensitive drum 211. The brush 213 extends over the entire width of the drum 211. The brush 213 is arranged upstream from the cleaning blade 214, as viewed circumferentially of the drum 211. Urged by the rotation of the drum 211, the cleaning brush 213 is rotated clockwise (in FIG. 1), which is opposite to the direction A1. The brush 213 serves to bring the leftover toner (which is removed from the drum surface by the cleaning blade 214) to the toner-discharging screw 221.

Though not shown in FIG. 1, a scraping plate is disposed upstream from the cleaning brush 213 as viewed circumferentially of the rotating drum 211. The non-illustrated scraping plate protrudes into the flexible filaments (not shown) of the brush 213. The scraping plate laterally extends over the entire width of the brush 213 (and hence the entire width of the drum 211).

Below the scraping plate is arranged the toner-discharging screw 221, which extends in parallel to the rotation axis of the drum 211. The toner-discharging screw 221 is rotated in a predetermined direction by a drive motor (not shown), so that the leftover toner is carried along the entire length of the rotating screw 221 by the spiral groove formed in the screw. In this manner, the leftover toner is moved toward one end (the "exit end" below) of the rotating screw 221.

For final collection of the leftover toner thus transferred, a discharged toner collector (not shown) is arranged below the exit end of the screw 221. With such an arrangement, the leftover toner brought to the exit end of the screw 221 is dropped into the discharged toner collector. The toner collector may be a used-up toner cartridge.

The cleaning unit 220 is enclosed by a cover 220*a*. Thus, the leftover toner is prevented from falling onto the photosensitive drum 211 until it is properly collected by the discharged toner collector.

A plurality of drum chargers 215 (two chargers in the illustrated embodiment) are provided downstream from the cleaning unit 220, as viewed circumferentially of the photosensitive drum 211. These drum chargers 215 uniformly charge the surface of the drum 211 to a predetermined electric potential.

The LED light irradiator 216 is disposed downstream from the drum chargers 215, as viewed circumferentially of the drum 211. The LED irradiator 216 is provided with an LED head for irradiating the surface of the drum 211 in a pattern corresponding to the image to be printed on the recording paper 1. The light irradiation makes a required electrostatic latent image on the drum 211.

The developing unit 219 is provided downstream from the LED irradiator 216, as viewed circumferentially of the drum 211. The developing unit 219 develops the latent image made by the LED light irradiator 216, so that the invisible latent image turns to be a visible toner image. A toner hopper 218 is attached to the developing unit 219 for supplying the unit 219 with toner to develop the latent images formed on the drum surface. The toner hopper 218 is arranged to releasably hold a toner cartridge 217.

The developing unit 219 is provided with a counter (not shown) which is arranged to count up every time a printing procedure is performed. The result (i.e., the count number) obtained by the counter is sent to the controller of the image-forming apparatus.

The recording paper 1 is brought into contact with the photosensitive drum 211 at a portion located downstream from the developing unit 219. Adjacent to this particular position, a transfer unit 212 is arranged in facing relation to the drum 211, with the recording paper 1 intervening therebetween. The transfer unit 212 is provided with a transfer charger 212*a* and a separation charger 212*b* arranged adjacent to the transfer charger 212*a*.

The transfer charger 212*a* charges the recording paper 1 by corona discharge, so that the paper 1 has a positive potential (as opposed to the toner particles, which are negatively charged). As a result, the toner image formed on the drum 211 is transferred to the paper 1. The separation charger 212*b* is positioned downstream relative to the transfer charger 212*a*, as viewed in the paper transfer path. The function of the separation charger 212*b* is to discharge the positively charged paper 1 for facilitating the detachment of the paper 1 from the drum 211.

After the toner image is transferred onto the paper 1, the surface of the drum 211 is subjected to toner-cleaning at the cleaning unit 220, so that toner particles remaining on the drum surface are removed.

As shown in FIG. 1, the second image-forming unit 260 is located above (and downstream from) the first image-forming unit 250. The second unit 260 is brought into contact with the obverse surface of the recording paper 1 to perform printing on this surface. The second unit 260 has the same arrangements as the first unit 250. Elements of the second unit 260 which are identical or similar to those of the first unit 250 are indicated by the same reference numerals, and no explanation about them is repeated.

The first and the second fixing units 410 and 420 cause the transferred toner images to be fixed to the recording paper 1 by flash light. For this purpose, each of the fixing units 410, 420 is provided with flash lamps 412 (such as xenon flash lamps), a reflection mirror 411, and a reflection plate 413 arranged in facing relation to the mirror 411.

The flash lamps 412 of the first fixing unit 410 are arranged on the reverse side of the paper 1, with the paper 1 intervening between the flash lamps 412 and the reflection plate 413. The reflection mirror 411 is also arranged on the reverse side of the paper 1 and behind the flash lamps 412. With such an arrangement, the paper 1 is efficiently irradiated by the flash light emitted from the lamps 412. In operation, the first fixing unit 410 serves to fix the toner image transferred onto the reverse surface of the paper 1.

As seen from FIG. 1, the second fixing unit 420 is similarly arranged as the first fixing unit 410, except for the necessary alterations for irradiating the obverse surface of the paper 1. The second unit 420 is located downstream from the first unit 410, as viewed along the paper transfer path. In operation, the second fixing unit 420 serves to fix the toner image transferred onto the obverse surface of the paper 1.

Both the first and the second fixing units 410, 420 are arranged within a duct 83 which communicates with the blower 8. In this manner, smoke and/or odor of organic macromolecular compounds (containing styrene, butadiene, phenol, etc.) generated at the first and the second fixing units 410, 420 are collected. As shown in FIG. 1, the blower 8 is provided with a fan 81 and a filter 82 including e.g. active carbon. In operation, the rotating fan 81 expels the inside smoke out of the duct 83 via the filter 82 serving to deodorize the smoke.

The power source 9 is provided for supplying power to the flash lamps 412 of the respective fixing units 410 and 420. Though not illustrated, the image-forming apparatus also includes a main power source arranged in a first housing 1001. The main power source supplies power to the first and the second image-forming units 250, 260 and the transfer system 700 for example.

The above-mentioned principal components (namely, the paper hopper 10, the transfer system 700, the first and the second image-forming units 250, 260, the first and the second fixing units 410, 420, the stacker 60, the blower 8, and the power source 9) and other components are managed by the controller of the image-forming apparatus. The first and second image-forming units 250, 260, the first and second fixing units 410, 420, and the transfer system 700 are accommodated in the first housing 1001, while the blower 8, the stacker 60, and the power source 9 are accommodated in a second housing 1002 adjacent to the first housing 1001.

This controller compares the count number information (which is sent from the developing unit 219 of the respective image-forming units 250, 260) with a predetermined value. When the comparison shows that the count number is greater than the predetermined value, the controller turns on an alarm lamp (not shown) to inform the user that the filter 82 should be replaced. When the old filter 82 is replaced by a new one, the controller resets the count number of the toner counter to zero.

The transfer system 700 is designed to move the recording paper 1 from the paper hopper 10 to the stacker 60 via the first image-forming unit 250, the second image-forming unit 260, the first fixing unit 410, and the second fixing unit 420. For this purpose, the transfer system 700 includes a tractor mechanism 710, a guide plate 75, first guide rollers 76, a second guide roller 77, third guide rollers 40 (41, 42), and a fourth guide roller 51.

The tractor mechanism 710, serving to move the recording paper 1 along the paper transfer path, is made up of a first tractor unit 72 and a second tractor unit 73. The first tractor unit 72 is arranged downstream from the second unit 73 along the paper transfer path. These two tractor units are arranged in the same manner. Each of them is provided with a pair of endless tractor belts (only one is shown in FIG. 1) 721 from which a plurality of feeding pins protrude at regular intervals to come into engagement with the indexing holes of the recording paper 1. Each tractor unit is also provided with a drive shaft 722 and a follower shaft 723 parallel to the drive shaft 722. The endless belts 721 extend around the drive shaft 722 and the follower shaft 723. A drive belt 725 extends around the drive shafts 722 of the first and the second tractor units 72, 73.

A reversible drive motor 724 is provided for rotating the drive shaft 722 forward and backward at required speeds. Upon actuation of the drive motor 724, the drive shafts 722 of the first and the second tractor units 72, 73 are caused to rotate in the same direction and in synchronism with each other. With such an arrangement, the recording paper 1 can be moved forward and backward selectively along the paper transfer path.

The tractor mechanism 710 is further provided with back tension means 71 arranged between the first and the second tractor units 72, 73. The back tension means is designed to exert a backward tension on the recording paper 1. The back tension means includes a pair of presser rollers: a drive roller 712 and a follower roller 711.

The drive roller 712 is connected to the drive motor 714 via a clutch 713. The drive roller 712 is rotated at required speeds forwarded backward by the motor 714.

The follower roller 711 is arranged above the drive roller 712 so that the recording paper 1 is held between these two rollers. The follower roller 711 is allowed for free rotation about a horizontal axis. Thus, when the recording paper 1 is moved along the transfer path, the follower roller 711 held in contact with the paper 1 is rotated forward or backward in accordance with the movement of the recording paper.

When the recording paper 1 is required to move forward (i.e., downstream along the paper transfer path), the drive roller 712 is caused to rotate forward by the motor 714. At this time, the circumferential speed of the drive roller 712 is rendered smaller than the transfer speed of the paper 1. Thus, the drive roller 712 exerts a tension or backward pulling force on the recording paper 1.

For ensuring a proper printing operation, the transfer speed of the paper 1 should be equal to the speed of the forwarding movement by the first and the second tractor units 72, 73. According to the present invention, the feeding pins of the tractor units 72, 73 are brought into engagement with only the "front portion" of each indexing hole. (An indexing hole has front and rear portions spaced from each other longitudinally of the paper 1, and the front portion is located downstream from the rear portion, as viewed along the paper transfer path.) In this manner, since no play is allowed to be present between the front portion of the indexing holes and the pins of the tractor units 72, 73, the recording paper can be moved immediately after the printing operation starts.

It is now supposed that the circumferential speed of the drive roller 712 is equal to V1, while the transfer speed of the recording paper 1 in performing printing is equal to V2(>V1). The difference between V2 and V1 is represented by $\Delta V$ (=V2−V1). According to the present invention, the ratio of $\Delta V$ to V2 is greater than 0 but equal to or smaller than 10%, that is, $0<(\Delta V/V2)\times 100\leqq 10$. By setting the difference $\Delta V$ in this range, the recording paper 1 is smoothly transferred along the predetermined path. If otherwise, the paper 1 may be torn at indexing holes due to the engagement with the pins of the tractor units.

When the recording paper 1 needs to be moved backward (i.e., upstream along the predetermined transfer path), the rotation of the drive motor 714 is reversed for causing the drive roller 712 to rotate backward. In this case, the drive motor 714 is operated so that the circumferential speed of the drive roller 712 is rendered faster than the transfer speed of the recording paper 1.

In this manner, the pins of the tractor units 72, 73 are brought into engagement with only the front portion of the indexing holes of the paper 1. This means that once a pin comes into engagement with an indexing hole, the pin will not move about within the hole. Due to this, the recording paper 1 is stably held by the tractor pins, which is advantageous for attaining smooth transfer of the recording paper 1 along the transfer path, in particular, near the first and the second image-forming units 250, 260.

Further, the engagement of the tractor pins with the front portion of each indexing hole is advantageous for attaining smooth switching of the paper transfer direction from backward to forward. Specifically, since the tractor pins are held in contact with the front portion of the indexing holes even when the paper 1 is transferred backward along the path, the paper 1 can be moved forward without delay after the rotation of the drive motor 724 is switched from the backward movement to the forward movement.

To replace the recording paper 1 with a different type of recording paper, the paper 1 is moved forward along the path at a speed faster than the normal speed for performing printing. In such an instance, without taking any countermeasures, the traction between the paper 1 and the drive roller 712 would exert an unduly large torque on the drive motor 714 via the drive roller 712 and might break the motor. According to the present invention, however, a clutch 713 is provided between the roller 712 and the motor 714. The clutch 713 is designed to break the mechanical linkage between the roller 712 and the motor 714 when the circumferential speed of the roller 712 becomes greater than a predetermined value (e.g. the normal transfer speed for performing printing). Thus, no unacceptably large force will be applied on the motor 714.

The paired third guide rollers 41, 42 are arranged between the second image-forming unit 260 and the first fixing unit 410. The recording paper 1 is held between these two rollers 41, 42 in contact with them. Specifically, the reverse surface of the paper 1 is held in contact with the roller 41, while the obverse surface of the paper 1 is held in contact with the other roller 42. Each of the third guide rollers 41, 42 is allowed for free rotation about a horizontal axis. Thus, the guide rollers 41, 42 are caused to rotate forward or backward in accordance with the movement of the recording paper 1.

According to the present invention, each of the third guide rollers 41, 42 has a length (the size of the roller as viewed widthwise of the paper 1) which is greater than the lengths of the photosensitive drums 211 of the first and the second image-forming units 250, 260. Further, the length of the third guide rollers 41, 42 is rendered greater than the length of the second fixing unit 420.

The third guide rollers 41, 42 exhibit a low transmittance for light and a low reflectance for light. Such a guide roller may be obtained in the following manner. First, aluminum tubing is prepared and painted black. Then, the black-painted aluminum tubing is subjected to surface processing with the use of fluorocarbon resin such as PFA (perfluoroalcoxy). Finally, the surface of the third guide rollers 41, 42 is negatively charged as the toner particles. Since the third guide rollers 41, 42 are coated with PFA and negatively charged, the toner particles are hardly adhered to them. Thus, the toner images transferred onto the paper 1 but still not fused will not be damaged while being moved between the third guide rollers 41, 42.

As shown in FIG. 1, the recording paper 1 is caused to overlap a certain area of the surface of the third guide roller 42, thereby deviating from the straight transfer path (see the broken line extending upward from the nip between the paired third guide rollers 41, 42) through a predetermined angle θ1. According to the present invention, the angle θ1 is preferably equal to or greater than 30 degrees.

In addition to the paper-guiding function, the third guide rollers 41, 42 also serve as light-shielding means. As shown in FIG. 1, the guide rollers 41, 42 are disposed between the second image-forming unit 260 and the first fixing unit 410. Thus, the paired guide rollers 41, 42 prevent light emitted by the first and second fixing units 410, 420 from reaching the first and second image-forming units 250, 260. It should be noted here that the length of the third guide rollers 41, 42 is rendered greater than those of the photosensitive drums 211 and second fixing unit 420, as previously described. Further, the third guide rollers 41, 42 have a low light transmittance and low light reflectance. With these features, the guide rollers 41, 42 can advantageously shield the light emitted from the fixing units 410, 420.

Under the light-blocking conditions, the life of the photosensitive drums 211 are advantageously prolonged. (Otherwise, the drums 211 would suffer from optical damage due to the exposure to the light from the fixing units 410, 420.) Further, the potential of the surface of the drums 211 can be kept at an appropriate level by avoiding the unfavorable light exposure. Thus, high quality printing can be performed.

The fourth guide roller 51 is disposed between the first fixing unit 410 and the second fixing unit 420. As shown in FIG. 1, the fourth guide roller 51 comes into contact with the reverse surface of the recording paper 1. The guide roller 51 is connected to a drive motor (not shown) for performing forward or backward rotation about a horizontal axis, so that the recording paper 1 is moved along the transfer path.

Before coming into contact with the fourth guide roller 51, the paper 1 extends vertically, as shown in FIG. 1. Then, the recording paper 1 is held in contact with a predetermined proportion of the surface of the fourth guide roller 51, so that the posture of the paper 1 becomes horizontal after passing the roller 51. In the illustrated embodiment, the angle θ2 (through which the paper 1 is bent by the roller 51) is about 90 degrees. Of course, the present invention is not limited to this particular angle, and preferably, the angle θ2 may be equal to or greater than 10 degrees. Due to the traction between the paper 1 and the fourth guide roller 51 in operation, the paper 1 is appropriately tensioned during the transfer of the paper 1, which is advantageous to smooth paper transfer.

In the illustrated embodiment, the fourth guide roller 51 comes into contact with the reverse surface of the paper 1 and hence with the toner images formed on the surface. Advantageously, these toner images have been fused onto the paper 1 by the first fixing unit 410 before they encounter the fourth guide roller 51. Thus, the toner images on the paper 1 will not be damaged through the contact with the fourth guide roller 51.

The fourth guide roller 51 has a length which is greater than that of the photosensitive drums 211 and that of the second fixing unit 420. As in the third guide rollers 41, 42, the fourth guide roller 51 has a low transmittance and low reflectance for light.

With the use of the fourth guide roller 51, the recording paper 1 is caused to extend horizontally at the second fixing unit 420. In this manner, the second fixing unit 420 can be disposed at a relatively low height, which is advantageous to the size reduction of the apparatus.

Further, with the illustrated arrangement, the photosensitive drum 211 of the second image-forming unit 260 is hidden from the second fixing unit 420 by the recording paper 1 whose transfer path is caused to protrude, by the fourth guide roller 51, into the space between the second fixing unit 420 and the second image-forming unit 260. Thus, the light emitted from the second fixing unit 420 will not reach the drum 211 of the unit 260. As for the first image-forming unit 250, it is arranged behind the recording paper 1 with respect to the second fixing unit 420. Thus, the light from the second fixing unit 420 will not reach the first image-forming unit 250, either.

Reference numeral 43 refers to light-shielding member, which is disposed between the second image-forming unit 260 and the first fixing unit 410. The light-shielding member 43 serves to interrupt the passage of light from the first fixing unit 410 toward the second image-forming unit 260.

The first guide rollers 76 are disposed at several locations along the paper transfer path. Together with the guide plate 75, which has a curved configuration, the first guide rollers 76 help the recording paper 1 to move along the predetermined transfer path. In the illustrated embodiment, four guide rollers 76 are depicted, thought the present invention is not limited to this.

As seen from FIG. 1, one of the four guide rollers 76 is arranged near the photosensitive drum 211 of the first image-forming unit 250. In association with the guide plate 75, the guide roller 76 leads the recording paper 1 from the second tractor unit 72 to the nip between the drum 211 of the first image-forming unit 250 and the transfer unit 212. The other three first guide rollers 76 are disposed between the second fixing unit 420 and the stacker 60 for guiding the paper 1 from the unit 420 to the stacker 60. In operation, these guide rollers 76 are rotated for moving the paper 1 along the transfer path. During this procedure, the traction between the rotating guide rollers 76 and the paper 1 causes the paper 1 to be properly tensioned, thereby preventing the paper 1 from wrinkling.

The second guide roller 77 is disposed upstream from the transfer unit 212 of the second image-forming unit 260, as viewed along the transfer path. Arranged on the reverse side of the paper 1, the second guide roller 77 comes into contact with the reverse surface of the paper 1 to guide the paper 1 toward the second image-forming unit 260.

The surface of the guide roller 77 is coated with a fluorocarbon resin, so that the surface of the roller 77 is highly resistive to wear which would otherwise be caused by the contact with the paper 1. In addition, the non-fused toner particles on the reverse surface of the paper 1 will be hardly stuck to the resin-coated surface. For improving the toner-repellent function, the second guide roller 77 is negatively charged, as with the third guide rollers 41, 42.

Though not illustrated in FIG. 1, a cleaning blade is held in contact with each of the second guide roller 77 and third guide rollers 41, 42. These cleaning blades scrape unnecessary toner particles off the surface of the guide rollers 77, 41 and 42 when these rollers are rotated forward for moving the paper 1 along the transfer path. In the illustrated embodiment, the guide rollers 77, 41 and 42 are designed to rotate only in the forward direction.

Each of the guide rollers 41, 42 and 77 can be moved away from the paper transfer path by a movable supporting device (not shown). For setting recording paper in the apparatus, the non-illustrated supporting device is operated to bring the rollers 41, 42 and 77 away from the transfer path, so that these rollers will not contact with the recording paper, which is moved faster at the time of paper setting. With such an arrangement, it is possible to prevent the rollers 41, 42 and 77 from being worn out by the recording paper fed at high speed.

Though not illustrated in FIG. 1, the transfer system 700 is provided with a transfer roller to contact with the paper 1 at a position between the second fixing unit 420 and the stacker 60. This non-illustrated transfer roller serves to move the recording paper 1 along the transfer path in synchronism with the tractor mechanism 710.

At the end of the paper transfer path, the recording paper 1 is received in the stacker 60. As shown in FIG. 1, the stacker 60 is provided with a swing guide 61 and a paper-stacking member 62. The swing guide 61 is pivotably supported by a horizontal shaft fixed to the upper end of the swing guide. The horizontal shaft is connected to driving means (not shown) for causing the swing guide 61 to pivot about the horizontal shaft (see the solid lines and double-dot chain lines). As guided by the pivoting guide 61, the recording paper 1 is stacked in the paper-stacking member 62 in an alternately folded manner.

The image-forming apparatus of the present invention is provided with a paper detector 74 disposed upstream from the second tractor unit 73 for checking if recording paper is present in the paper hopper 10. In the illustrated embodiment, the paper detector 74 is an optical sensor consisting of a light-emitting element and a light-receiving element. These two elements are held in facing relation to each other, with the paper transfer path extending therebetween, as illustrated in FIG. 1.

When recording paper is present between the two optical elements, the light emitted from the light emitting-element is interrupted by the paper 1, whereby the light-receiving element receives no light. In this case, the controller of the image-forming apparatus determines that the recording paper has not run out yet. On the other hand, when the paper 1 is entirely paid out of the paper hopper 10, then the light-receiving element detects the light emitted from the counterpart. In this instance, the controller of the image-forming apparatus determines that the paper hopper 10 is empty. The user is informed of this fact through a display unit (not shown).

The operation of the above-arranged image-forming apparatus will now be described below.

For performing printing with the image-forming apparatus of the present invention (simply called "printer" below), first the user sets recording paper in the paper hopper 10. Then, the user brings the indexing holes of the paper 1 into engagement with the tractor pins of the tractor belts 721 of the second tractor unit 73.

Thereafter, print data is supplied to the printer under the control of a host computer. Upon receiving the print data, the printer starts the required printing operation.

Specifically the transfer system 700 advances the paper 1 along the transfer path toward the first image-forming unit 250. In synchronism with the transfer of the paper 1, the photosensitive drum 211 is driven by a motor (not shown) to rotate forward or in the direction A1 (counterclockwise in FIG. 1). The drum chargers 215 of the first image-forming unit 250 uniformly charge the surface of the drum 211. Then, the LED light irradiator 216 irradiates the drum surface with light, based on given image signals, to form electrostatic latent images on the drum surface.

Then, the developing unit 219 develops the latent images on the drum surface. Thus, visible toner images corresponding to the given image signals are produced.

According to the present invention, the absolute value of the potential of the drum surface is reduced incrementally from the time the toner images are produced until the images are transferred onto the paper 1. The specific techniques for doing this will be described later.

After the toner images are produced, the transfer charger 212*a* positively charges the paper 1, so that the toner images (made up of the negatively charged toner particles) are attracted by the paper 1 and transferred onto the reverse surface of the paper. Then, the paper 1 is discharged by the separation charger 212*b* to facilitate detachment of the paper 1 from the drum 211.

After the toner images are transferred, the unnecessary toner particles remaining on the drum surface are removed by the the cleaning unit 220. Then, once again, the drum 211 is uniformly charged by the drum chargers 215 to repeat the above-described image-forming and image-transferring procedure.

Meanwhile, the recording paper 1 is being moved along the transfer path by the transfer system 700 to be fed to the second image-forming unit 260. The second unit 260, operating on the same principle as the first image-forming unit 250, produces non-fused toner images on the obverse surface of the paper 1 as it is being rotated forward or in the direction A2 (clockwise in FIG. 1).

Then, the recording paper 1 with the non-fused toner images formed on both sides, continues to be moved along the transfer path by the transfer system 700. After passing the third guide rollers 41, 42 and the light-shielding member 43, the first fixing unit 410 fuses the toner image to the reverse surface of the paper 1.

Then, the transfer system 700 brings the paper 1 to the second fixing unit 420. The toner images on the obverse surface of the paper 1 are fused by the second unit 420.

As being guided by the guide rollers 76, the paper 1 is advanced along the transfer path by the transfer system 700. Finally, the paper 1 is received by the stacker 60.

Figure 2:
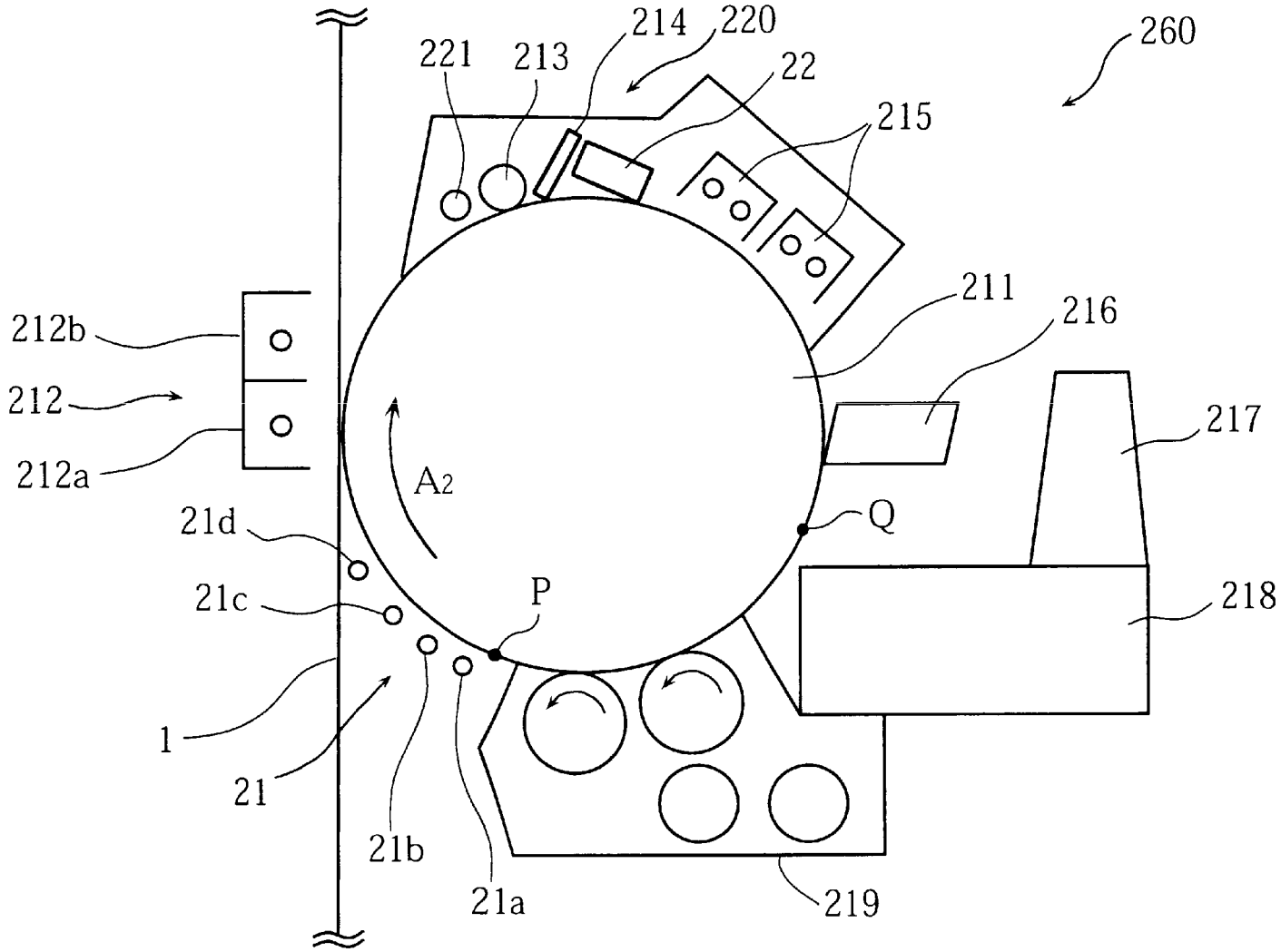
FIG. 2 is an enlarged side view schematically showing a image-forming unit incorporated in the apparatus of FIG. 1.

Reference is now made to FIG. 2 showing the outline of the second image-forming unit 260. As previously mentioned, the first image-forming unit 250 is arranged in the same manner as the second image-forming unit 260. Thus, the following detailed description is made only to the second image-forming unit 260.

As shown in FIG. 2, the second image-forming unit 260 is provided with a pre-transfer discharger 21 which includes four light sources 21*a*–21*d* disposed between the developing unit 219 and the transfer unit 212. Each of these light sources consists of an array of light-emitting diodes (LEDs). The four light sources 21*a*–21*d* are arranged at predetermined intervals along the cylindrical surface of the drum 211.

With the above arrangement, the light sources 21*a*–21*d* irradiate different regions of the surface of the drum 211, respectively. Each irradiated region has a rectangular configuration, extending over the entire length of the drum 211 and over a certain length as viewed circumferentially of the drum surface. The specific light energy of the light emitted from each light source to irradiate the drum surface is equal to or smaller than one fifth (⅕) of the specific light energy of the light emitted from a discharger 22 arranged adjacent to the drum chargers 215. The discharger 22 is provided for eliminating remnant charges on the drum surface. Here, the "specific light energy" is defined as the energy of light shining upon the unit area of the surface of the drum 211.

Typically, the discharge 22 is designed to emit light whose specific light energy is two or three times greater than that required for making the potential of the drum surface zero (V). Thus, by making the specific light energy of the light sources 21*a*–21*d* no greater than ⅕ of that of the discharger 22, it is possible to incrementally reduce the potential of the drum surface by the light emitted from the respective light sources 21*a*–21*d*.

Specifically, the photosensitive drum 211 is an OPC (organic photoconductive) drum. The surface potential at and about a position Q (FIG. 2) is −650V. The light emitted from the LED light irradiator 216 has a wavelength of 720 nm, and the energy of the light measured at the surface of the drum 211 is 1 $\mu J/cm^2$. The developing potential of the developing unit 219 is −500V. The developer is made up of two components, that is, negatively charged toner and ferrite carrier. The proportion of the toner in the developer is 5% wt. The transfer charger 212*a* of the transfer unit 212 is provided with a corona wire and operates on a constant-current control system. The transfer current of the transfer charger 212*a* is 500 $\mu$A. The separation charger 212*b* of the transfer charger 212 is supplied with an alternating voltage whose peak-to-peak amplitude is 10 kV upon which a constant voltage of 500V is superimposed as an offset voltage. The discharger 22 is provided with an LED array capable of emitting light whose wavelength is 660 nm and whose energy is 1 $mW/cm^2$ measured on the surface of the drum 211. The light sources 21*a*–21*d* emit light whose wavelength is 660 nm and whose energy is 0.1 $mW/cm^2$ measured on the surface of the drum 211. The wavelength (660 nm) of the light from the discharger 22 and light sources 21*a*–21*d* is determined so that the spectral sensitivity of the photosensitive drum 211 is rendered maximum or nearly maximum.

According to the present invention, however, the wavelength of the light emitted from the discharger 22 does not need to be equal to that of the light emitted from the light sources 21*a*–21*d*. For instance, the wavelength of the light from the light sources 21*a*–21*d* may be determined so that the spectral sensitivity of the photosensitive drum 211 becomes half the maximum value or smaller. As a result, the absolute value of the surface potential of the photosensitive drum 211 can be reduced as required, without rendering the specific light energy of the light sources 21*a*–21*d* unduly small.

Referring back to FIG. 2, a given point P in the background portion of the surface of the drum 211 is first irradiated by the light source 21*a* as the drum 211 is rotating in the direction A2. Then, the point P is sequentially irradiated by the second light source 21*b*, the third light source 21*c* and the fourth light source 21*d* in this order, until it is brought to the transfer unit 212. As a result of this, the absolute value of the potential at the point P is incrementally reduced through four steps.

Specifically, the potential of the point P is −650V when the point P is located between the developing unit 219 and the LED light irradiator 216. Then, the potential is "increased" (in terms of absolute value, "reduced") to −600V while the point P is passing the developing unit 219. Thereafter, the potential of the point P is increased to −450V due to the irradiation by the first light source 21*a*, to −300V due to the irradiation by the second light source 21*b*, to −150V due to the irradiation by the third light source 21*c*, and to 0V due to the irradiation by the fourth light source 21*d*.

With such an arrangement, the conventional problem of "print dust" is overcome since an abrupt change in absolute value of the surface potential of the drum 211 is avoided.

The inventors made an experiment to see how the occurrence of print dust is related to the surface potential of a photosensitive drum. The image-forming unit which the inventors prepared for conducting the experiment is like the one shown in FIG. 2, but has only one light source disposed between the developing unit and the transfer unit instead of the four light sources 21*a*–21*d*. With the unit of the experiment, the surface potential of a given point of the photosensitive drum is changed only once (i.e., by one step) by irradiation of light, from an initial value to post-irradiation values. Here, the initial value is the potential which the given point in the drum surface has immediately after the point has passed the developing unit (see the point P in FIG. 2). The results of the experiment are shown in FIGS. 3 and 4.

FIG. 3 is a table showing a situation where the initial value is set at −700V, and the post-irradiation potentials are −600, −550, −500, −450, −400, −200 and 0. In FIG. 4, the initial value is −550V, and the post-irradiation potentials are −500, −450, −400, −350, −300, −250, −200 and 0. The "ΔPOTENTIAL" column of each table shows the difference between the initial value and the respective post-irradiation potentials. Referring to FIG. 3 for example, when the surface potential is changed from the initial value (−700V) to a post-irradiation potential of −600V, the "ΔPOTENTIAL" is equal to 100V[=−600−(−700)].

The "EVALUATION" column of each table shows, by five grades (1–5), how much print dust is observed. Specifically, the number "5" indicates that no print dust is observed, whereby the print quality is superb. The number "4" indicates that a very small amount of print dust occurs which causes substantially no damage to the print quality. The number "3" indicates that the occurrence of print dust is rather conspicuous, but the print quality is still acceptable. The number "2" indicates that a large amount of print dust is observed which adversely affects the print quality. The number "1" indicates that a very large amount of print dust is observed, whereby the print quality is rendered the worst.

The "PRINT DUST" column in each table shows three symbols "○", "Δ", or "X". "○" corresponds to the evaluation number "5", "Δ" corresponds to the evaluation numbers "4" and "3", and "X" corresponds to the evaluation numbers "2" and "1".

Figure 5:
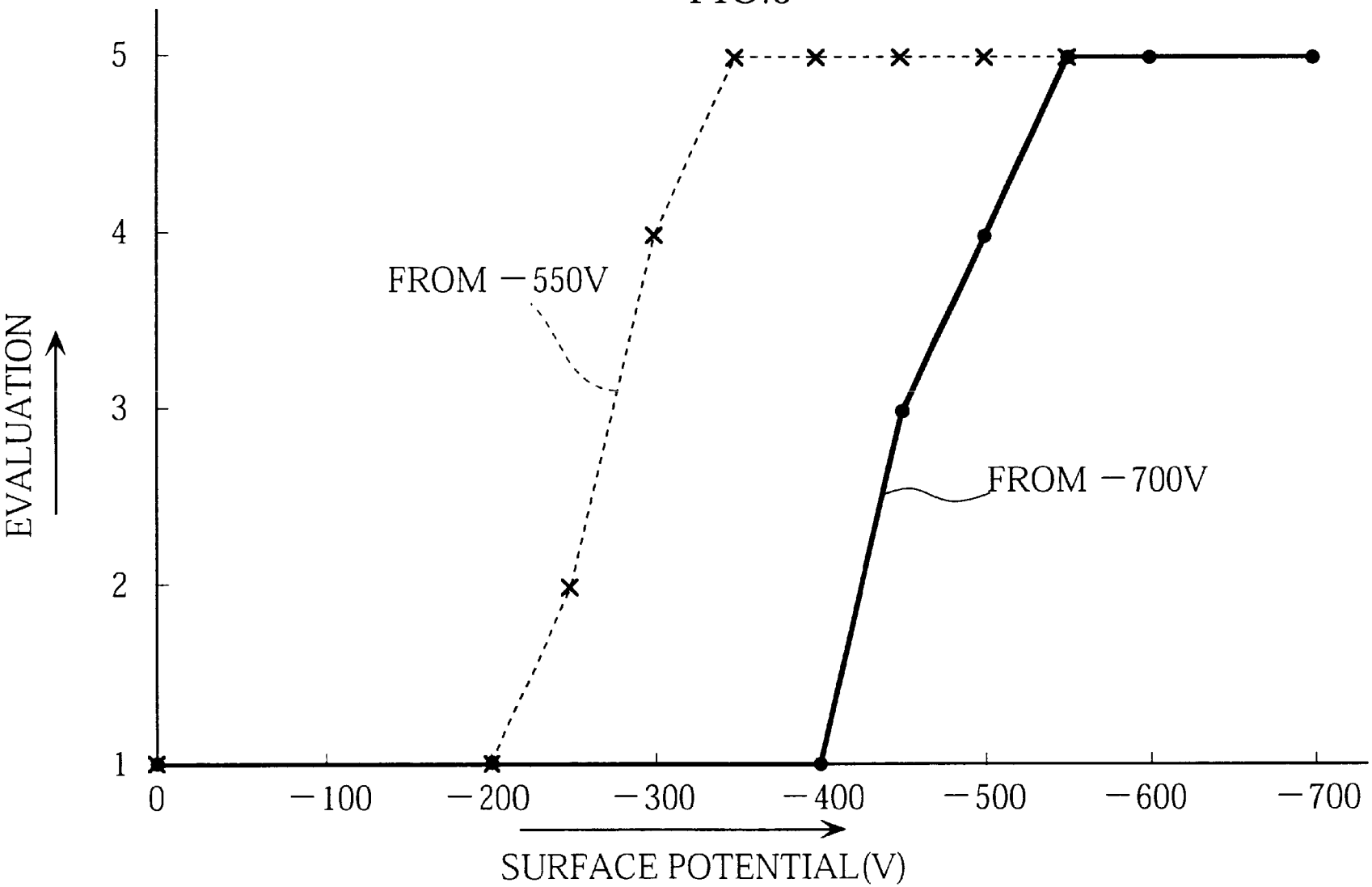
FIGS. 5 and 6 are graphs showing the relationship between the potential variation on the drum surface and the occurrence of the print dust.
Figure 6:
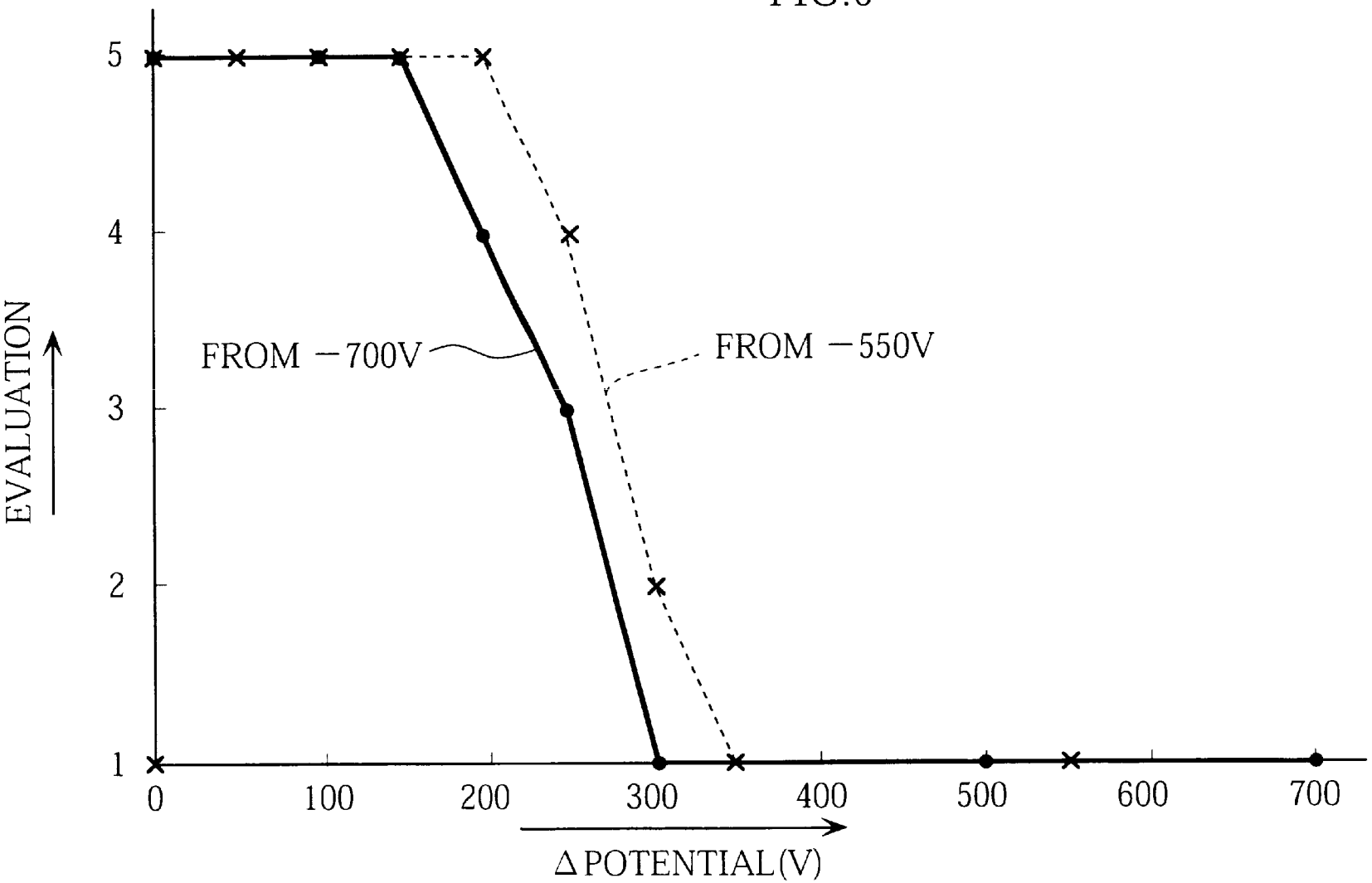

Based on the data shown in FIGS. 3 and 4, the graphs shown in FIGS. 5 and 6 are obtained. The graph of FIG. 5 shows the relationship between the post-irradiation surface potential and the evaluation point representing the occurrence of print dust. The solid line connecting the symbols "●" corresponds to the table of FIG. 3, while the broken line connecting the symbols "X" corresponds to the table of FIG. 4.

The graph of FIG. 6 illustrates the relationship between the Δpotential and the evaluation point representing the occurrence of print dust. In this graph again, the solid line connecting the symbols "●" corresponds to the table of FIG. 3, while the broken line connecting the symbols "X" corresponds to the table of FIG. 4.

These tables and graphs show that the occurrence of print dust is related to the variations in surface potential of the photosensitive drum rather than to the absolute value of the surface potential. In fact, as best shown in FIG. 6, the print dust tends to occur more frequently as the Δpotential becomes greater beyond a certain threshold, whether the initial surface potential is −700V or −550V.

In the case where the initial surface potential is −700V, a very small amount of print dust (Evaluation "4") is observed when the Δpotential is 200V. On the other hand, no print dust is observed when the Δpotential is no greater than 150V. In the case where the initial surface potential is −550V, a very small amount of print dust (Evaluation "4") is observed when the Δpotential is 250V. On the other hand, no print dust is observed when the Δpotential is no greater than 200V. In any case, the occurrence of print dust is prevented by rendering the Δpotential no greater than 150V, whether the initial surface potential is −700V or −550V.

As seen from the above, it is possible to prevent print dust from occurring by incrementally reducing the surface potential of a photosensitive drum through a plurality of steps. For instance, the surface potential of a photosensitive drum may be increased (or "decreased" in terms of absolute value) from −700V to −550V (first step), and then to −400V (second step), and then to −250V (third step), and then to −100V (fourth step), and finally to 0V (fifth step).

When the user does not care about a small amount of print dust, the surface potential may be increased from −700V to −500V (first step), and then to −250V (second step), and finally to 0V (third step).

Figure 7:
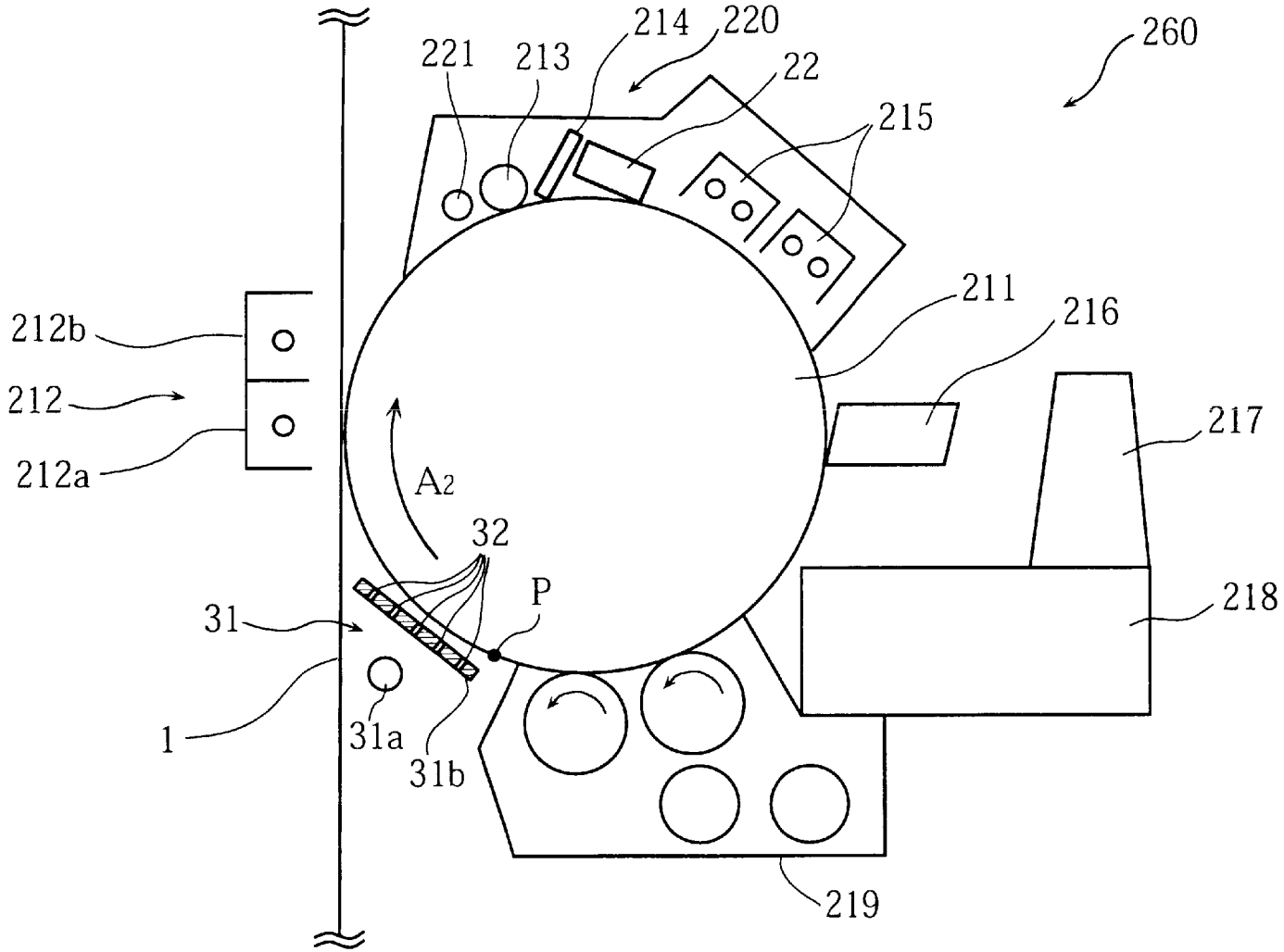
FIG. 7 is a side view showing a modified version of image-forming unit.

Reference is now made to FIG. 7 showing principal elements of an image-forming apparatus or printer according to a second embodiment of the present invention. The printer of the second embodiment is similar to the printer of the first embodiment described above, except that the pre-transfer discharger 31 is provided with only one light source 31*a* associated with a slit plate 31*b*. The light source 31*a* is provided with an LED array for emitting light. The slit plate 31*b* is held in facing relation to the photosensitive drum 211 between the developing unit 219 and the transfer unit 212. The slit plate 31*b* has a rectangular configuration and its length is equal to or greater than that of the photosensitive drum 211. The slit plate 31*b* is formed with a predetermined number of slits 32 each of which extends in parallel to the rotation axis (not shown) of the drum 211.

With such an arrangement, the light emitted from the light source 31*a* is split into several light beams (five beams in the illustrated embodiment) by the slit plate 31*b*, and irradiates several strip-like regions on the surface of the drum 211. In this manner again, the absolute value of the surface potential of the drum 211 can be incrementally reduced between the developing unit 219 and the transfer unit 212.

Figure 8:
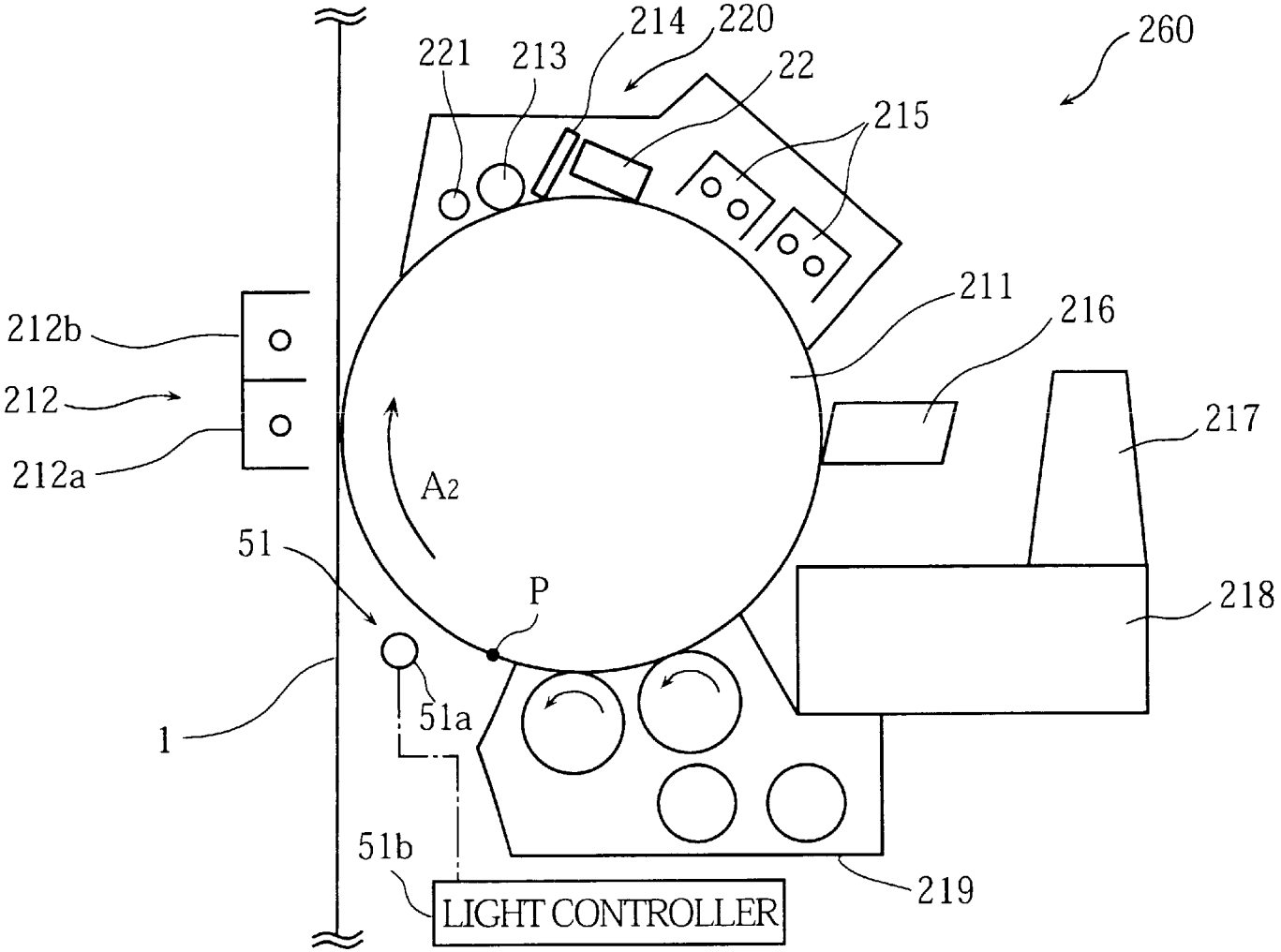
FIG. 8 is a side view showing another modified version of image-forming unit.
Figure 9:
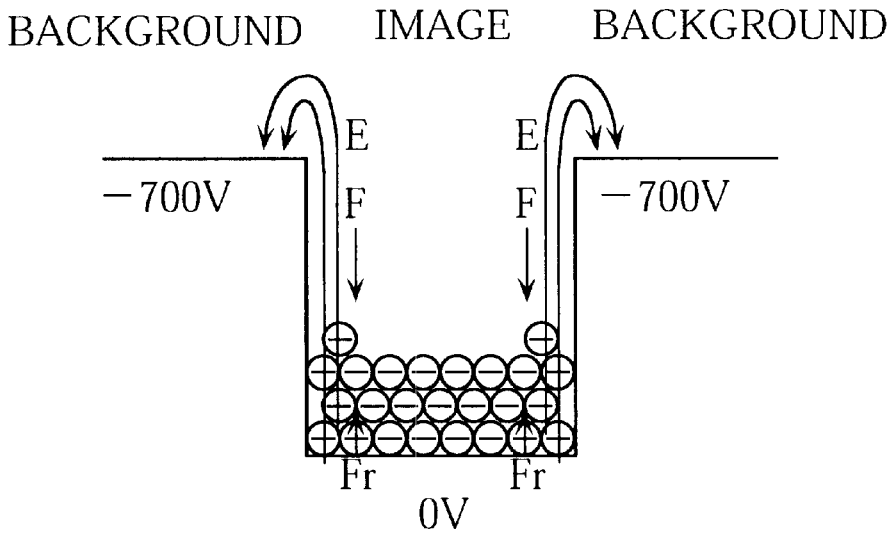
FIG.9 PRIOR ART
FIG. 9 illustrates how the print dust occurs in a conventional image-forming apparatus.
Figure 10:
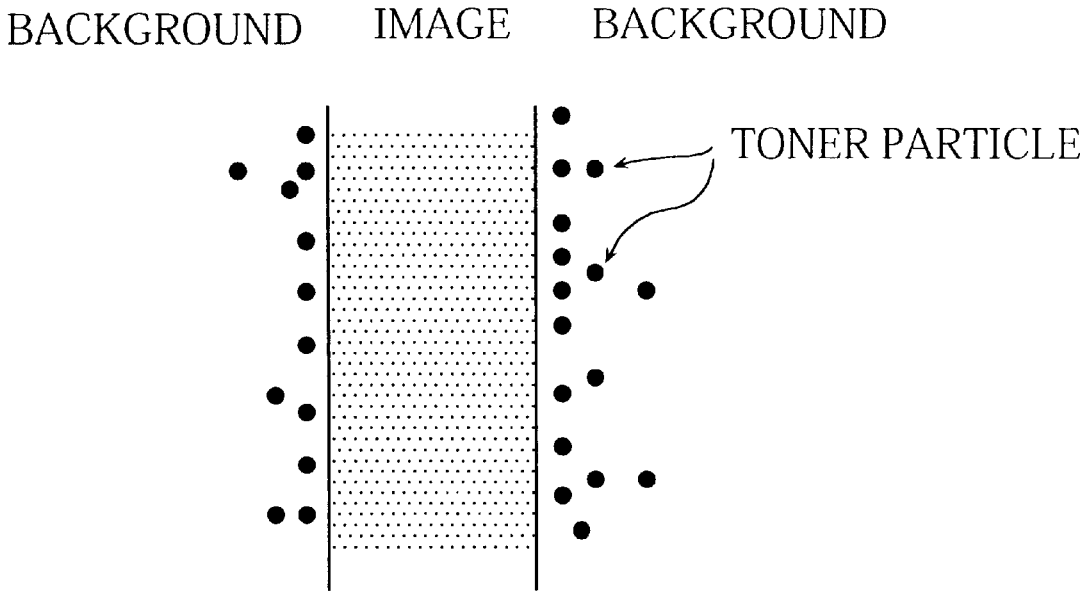
FIG.10 PRIOR ART
FIG. 10 shows an unfavorable printing result with print dust staining the background portion on the drum surface.

FIG. 8 shows principal elements of an image-forming apparatus or printer according to a third embodiment of the present invention. According to this embodiment, the pre-transfer discharger 51 is provided with one light source 51*a* and a light controller 51*b* for controlling the actuation of the light source 51*a*. The light source 51*a* is provided with an LED array for irradiating the surface of the drum 211 between the developing unit 219 and the transfer unit 212. The light source 51*a* is turned on and off at predetermined time intervals under the control of the light controller 51*b*. For instance, the light source 51*a* may be turned on (and off immediately thereafter) two or three times (or more) while a given point P on the drum surface is being brought from the developing unit 219 to the transfer unit 212. With such an arrangement again, the absolute value of the surface potential of the drum 211 is incrementally reduced.

In the embodiments described above, use is made of a photosensitive drum for forming electrostatic latent images. The present invention, however, is not limited to this. For instance, a photosensitive belt may be used in place of the photosensitive drum. Further, according to the present invention, the developer may be a single-component one containing no ferrite carrier.

The image-forming apparatus according to the above-described embodiments is a printer designed to perform printing on both the obverse and reverse surfaces of recording paper. Of course, the present invention is not limited to this and applicable to many other types of electrophotographic printers.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. An electrophotographic image-forming apparatus comprising:

a photosensitive member having a surface upon which an electrostatic image is produced;

a developing unit arranged adjacent to the photosensitive member;

an image transfer unit arranged adjacent to the photosensitive member; and a pre-transfer discharger arranged adjacent to the photosensitive member between the developing unit and the image transfer unit, wherein the pre-transfer discharger is arranged to progressively reduce an absolute value of an electric potential of a given point in said surface of the photosensitive member through a plurality of steps as said given point is moved from the developing unit to the image transfer unit.

2. The image-forming apparatus according to claim 1, wherein the pre-transfer discharger is provided with a plurality of light sources for irradiating different portions of said surface of the photosensitive member.

3. The image-forming apparatus according to claim 2, wherein the photosensitive member comprises a drum rotatable about an axis, the light sources are spaced from each other circumferentially of the drum.

4. The image-forming apparatus according to claim 1, wherein the pre-transfer discharger is provided with a single light source and a slit plate located between the photosensitive member and the light source.

5. The image-forming apparatus according to claim 4, wherein the slit plate is formed with a plurality of slits for splitting light from the light source to irradiate different portions of said surface of the photosensitive member.

6. The image-forming apparatus according to claim 1, wherein the pre-transfer discharger is provided with a single light source and a light controller for repeatedly turning on the light source at predetermined time intervals as said given point is moved from the developing unit to the image transfer unit.

7. The image-forming apparatus according to claim 1, further comprising a remnant charge discharger for irradiating the photosensitive member with light after a developed image is transferred onto recording medium, wherein the pre-transfer discharger is arranged to emit light whose specific light energy is no greater than one fifth of a specific light energy of the light from the remnant charge discharger.

8. The image-forming apparatus according to claim 1, wherein the pre-transfer discharger is arranged to emit light of a predetermined wavelength which renders a spectral sensitivity of the photosensitive member no greater than half a maximum.

9. The image-forming apparatus according to claim 1, wherein the pre-transfer progressively reduces the absolute value of the electric potential of said given point by no greater than 150V at one time.

* * * * *